US008960487B1

(12) United States Patent
Parke

(10) Patent No.: US 8,960,487 B1
(45) Date of Patent: Feb. 24, 2015

(54) BEVERAGE CAN WITH INTEGRAL TAB LIFTER

(76) Inventor: William Holt Parke, Boyce, VA (US)

( * ) Notice: Subject to any disclaimer, the term of this patent is extended or adjusted under 35 U.S.C. 154(b) by 405 days.

(21) Appl. No.: 13/315,572

(22) Filed: Dec. 9, 2011

(51) Int. Cl.
*A47G 19/22* (2006.01)

(52) U.S. Cl.
USPC ..... 220/703; 220/309; 220/3.15; 220/281; 220/285; 81/3.09; 81/3.15

(58) Field of Classification Search
CPC ..... B65D 41/02; B65D 17/32; B65D 2517/0079; B65D 2517/0016; B65D 2517/0073; B65D 17/161; B65D 51/20; B67B 7/00; B67B 7/44; B67B 7/403
USPC ..... 53/492; 220/277, 380, 23.6, 23.4, 906, 220/266, 267, 278, 269, 270, 286, 703, 718, 220/254.6, 255, 256.1, 258.2, 258.5, 285; 206/504, 508, 509; 81/3.09, 3.15, 3.55, 81/3.47, 3.57; 222/80, 81, 83; 30/443, 30/400, 437
See application file for complete search history.

(56) References Cited

U.S. PATENT DOCUMENTS

| | | | | |
|---|---|---|---|---|
| 1,810,630 | A * | 6/1931 | Tapp | 81/3.09 |
| 2,322,843 | A * | 6/1943 | Deane | 81/3.15 |
| 2,547,059 | A * | 4/1951 | Taylor et al. | 81/3.15 |
| 2,745,301 | A * | 5/1956 | Grunwald | 81/3.15 |
| 3,042,249 | A | 7/1962 | Favolise | |
| 3,236,126 | A * | 2/1966 | Martinmaas | 81/3.15 |
| 3,286,874 | A * | 11/1966 | Bozek | 220/267 |
| 3,370,743 | A | 2/1968 | Terriza | |
| 4,084,723 | A | 4/1978 | Parker | |
| 5,573,133 | A * | 11/1996 | Park | 220/4.27 |
| 7,343,834 | B2 * | 3/2008 | Howlett et al. | 81/3.09 |
| 8,540,105 | B2 * | 9/2013 | Yasui | 220/380 |
| 2006/0016294 | A1 * | 1/2006 | McGrath et al. | 81/3.09 |
| 2007/0095847 | A1 * | 5/2007 | Gruver et al. | 220/780 |
| 2008/0098853 | A1 * | 5/2008 | Choate | 81/3.09 |

* cited by examiner

*Primary Examiner* — Stephen F Gerrity
*Assistant Examiner* — Joy N Sanders
(74) *Attorney, Agent, or Firm* — Robert C. Montgomery; Montgomery Patent & Design

(57) ABSTRACT

A beverage can with an integral tab lifter includes a cylindrical can body with a tab-style pop-top opening along an upper surface. A tab lifting flange feature is located along a bottom edge of the can body. The tab of another pop-top beverage can is opened by lifting upwardly on a tab by utilizing the tab lifting flange of a beverage positioned above the lifting tab. The tab lifting flange is an inwardly-protruding lip which extends over a short plane parallel to the lower surface of the beverage can. To open the can, the tab lifting flange of a first can is placed upon the top surface of a second can. The first can is motioned such that the tab lifting flange captures and lifts the tab and opens the second can. In this manner, each can acts as a tab-opener for other cans.

6 Claims, 4 Drawing Sheets

BEVERAGE CAN WITH INTEGRAL TAB LIFTER

RELATED APPLICATIONS

Not Applicable.

FIELD OF THE INVENTION

The present invention relates generally to beverage cans, and in particular, to pop-top beverage can having an integral tab lifter for opening other pop-top beverage cans.

BACKGROUND OF THE INVENTION

Just about every type of beverage is available in cans today. Everything including beer, soda, and juice is packaged in lightweight aluminum cans for consumer convenience. This "ready-to-consume" convenience makes them ideal for use at work, home, sporting events and the like. Unfortunately, many people such as children and the elderly experience difficulty when trying to open the pop-top lifting tab. It is extremely difficult for many to get their finger underneath the pull tab top and apply adequate pressure to open the can. People must risk hurting their finger, breaking a fingernail, or experience the embarrassment of asking someone else to open the can for them. While various types of can and bottle opening devices are known, however, in many situations their availability when needed is limited.

SUMMARY OF THE INVENTION

The inventor has recognized the aforementioned inherent problems and lack in the art and observed that there is a need for a device by which pull top beverage cans are easily opened by anyone without the need of a separate can opener.

Accordingly, it is an object of the present embodiments of the invention to solve at least one (1) of these problems. The inventor has addressed this need by developing a beverage can with integral tab lifter that allows for easy opening of pull tab beverage cans in a manner which is quick, easy, and effective. The inventor has thus realized the advantages and benefits of providing a beverage can body having a cylindrical sidewall, a closed upper surface, a closed lower surface, a tapered top flange extending upwardly from a perimeter of the upper surface, and a tapered bottom flange extending downwardly from a perimeter of the lower surface. A fluid opening is defined by a scored area and is disposed in the upper surface. A tab is pivotably attached to the upper surface adjacent to the fluid opening. The tab includes a lift end on one (1) side of a pivot point and a puncturing end on the opposite side of the pivot point. The puncturing end is directed over the scored area. A generally flat and annular tab lifting flange protrudes inwardly from a perimeter of the bottom flange for fitting underneath a lift tab of a subjacently positioned beverage can. A circular bottom opening is defined by a perimeter edge of the tab lifting flange for at least partially receiving a lift tab of the subjacently positioned beverage can.

In use, the tap lifting flange of the beverage can captures a lift end of a lift tab of the subjacently positioned beverage can, such that rotation of the beverage can about the subjacently positioned beverage can top flange lifts the subjacently positioned lift tab to puncture the subjacently positioned beverage can upper surface about the subjacently positioned beverage can scored area in response to an applied downward force.

The invention, unlike previous attempts provides a device and method for easily opening pop-top beverage cans without the need for an opening tool, fingernails, or can opener, particularly when such a tool is unavailable.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
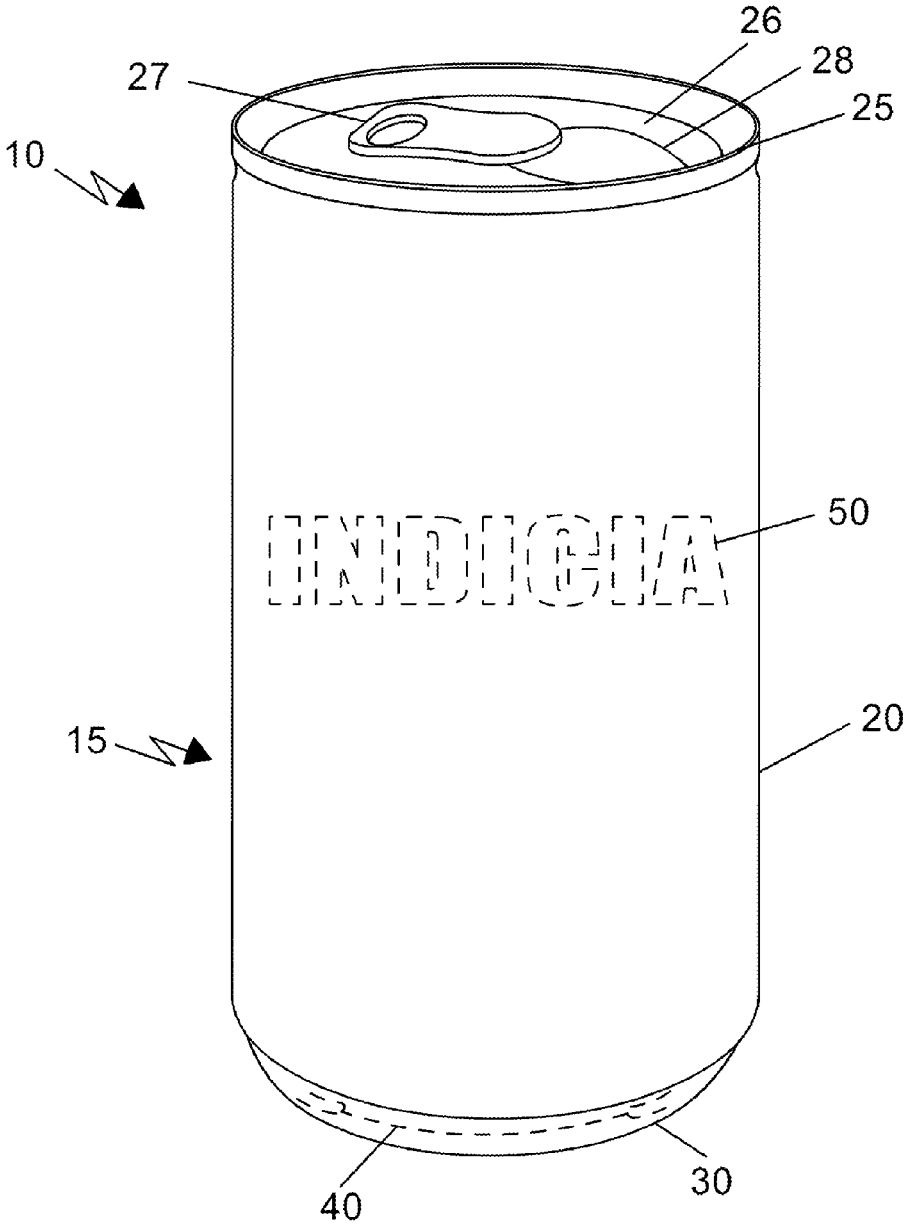
FIG. 1 is a perspective front view of a beverage can with integral tab lifter in accordance with the present invention.

10 beverage can with integral tab lifter
15 beverage can
20 body
25 top flange
26 upper surface
27 tab
28 fluid opening
30 bottom flange
32 lower surface
40 tab lifting flange
42 bottom groove
50 indicia

DETAILED DESCRIPTION OF THE PREFERRED EMBODIMENT

In accordance with the invention, the best mode is presented in terms of a preferred embodiment, herein depicted within FIGS. 1 through 4. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 4, depicting beverage can with an integral tab lifter (herein described as a "device") 10, where like reference numerals represent similar or like parts. In accordance with the invention, the present disclosure describes is the device 10 having a bottom flange 30 which provides an aid to lift a pull tab 27 of another beverage can.

Figure 2B:
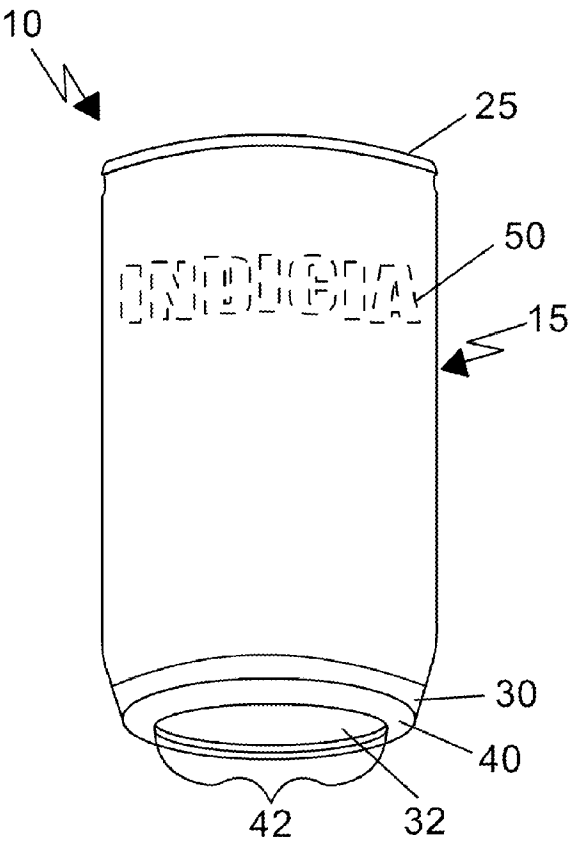
FIG. 2*b* is a perspective bottom view of the beverage can with integral tab lifter.
Figure 2A:
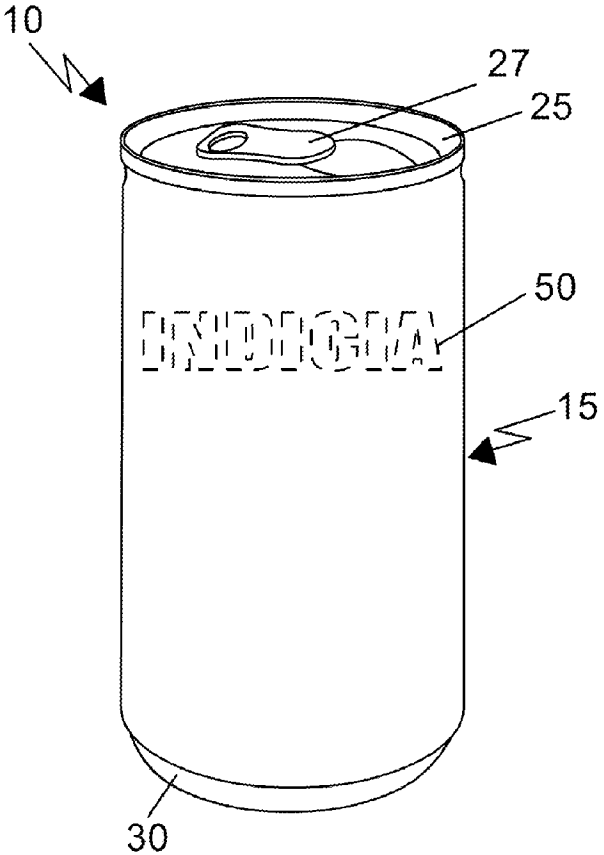
FIG. 2*a* is a perspective top view of the beverage can with integral tab lifter.

Referring now to FIGS. 1, 2*a*, and 2*b*. FIG. 1 shows perspective front view of the device 10. FIG. 2*a* shows a perspective top view of the device 10. FIG. 2*b* shows a perspective bottom view of the device 10. The device 10 includes a metal beverage can 15 having a cylindrical body 20, a top flange 25, and a slightly inward tapering bottom flange 30. The bottom flange 30 also includes an integral tab lifting flange 40 formed by an inwardly protruding circular appendage which extends toward a center point from a perimeter edge of the bottom flange 30 forming a circumscribed bottom groove 42. The shape of the tab lifting flange 40 enables engagement and partial entrapment of a lifting tab 27 located upon an upper surface 26 of a subjacent beverage can 15, see FIGS. 3 and 4. The beverage can 15 is suitable for containing liquids such as, but not limited to: soft drinks, alcoholic beverages, water, and the like, and is has an exterior surface adapted for the display of various types of indicia 50.

Figure 3:
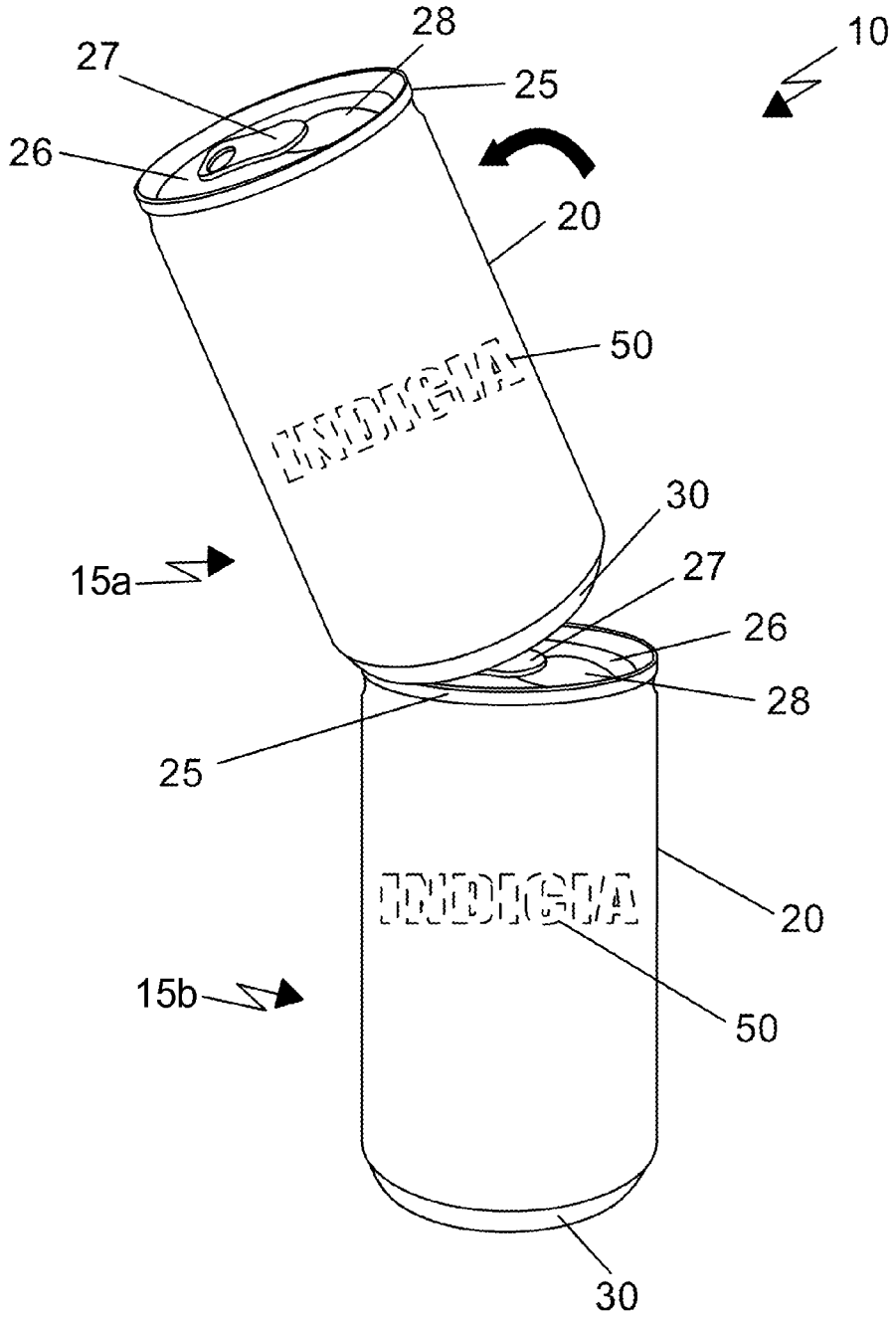
FIG. 3 is a perspective view of the beverage can with integral tab lifter depicted an in-use state; and, FIG. 4 is a section view of the beverage can with integral tab lifter.

Referring now to FIG. 3, which shows a perspective view of the device 10 depicted in an in-use state. The tapered side surfaces and bottom groove 42 of the bottom flange 30 allow for at least partial insertion with top flange 25 of the subjacently positioned beverage can 15. The low-profile position of the tab lifting flange 40 is designed to capture an outer edge of the tab 27 and engage it in order to easily lift the pull tab 27 of the subjacent beverage can 15 upwardly to break the seal created by the fluid opening 28 of the subjacent beverage can 15.

The tab lifting flange 40 provides easy lifting of the tab 27, thereby reducing a risk of breaking fingernails, hurting fingers, or requiring help from others to open the beverage can 15. Additionally, as the first beverage can 15 becomes empty, it can be used to open another full beverage can 15. In like manner, a full beverage can 15 can be utilized to open another full beverage can 15 as well.

Figure 4:
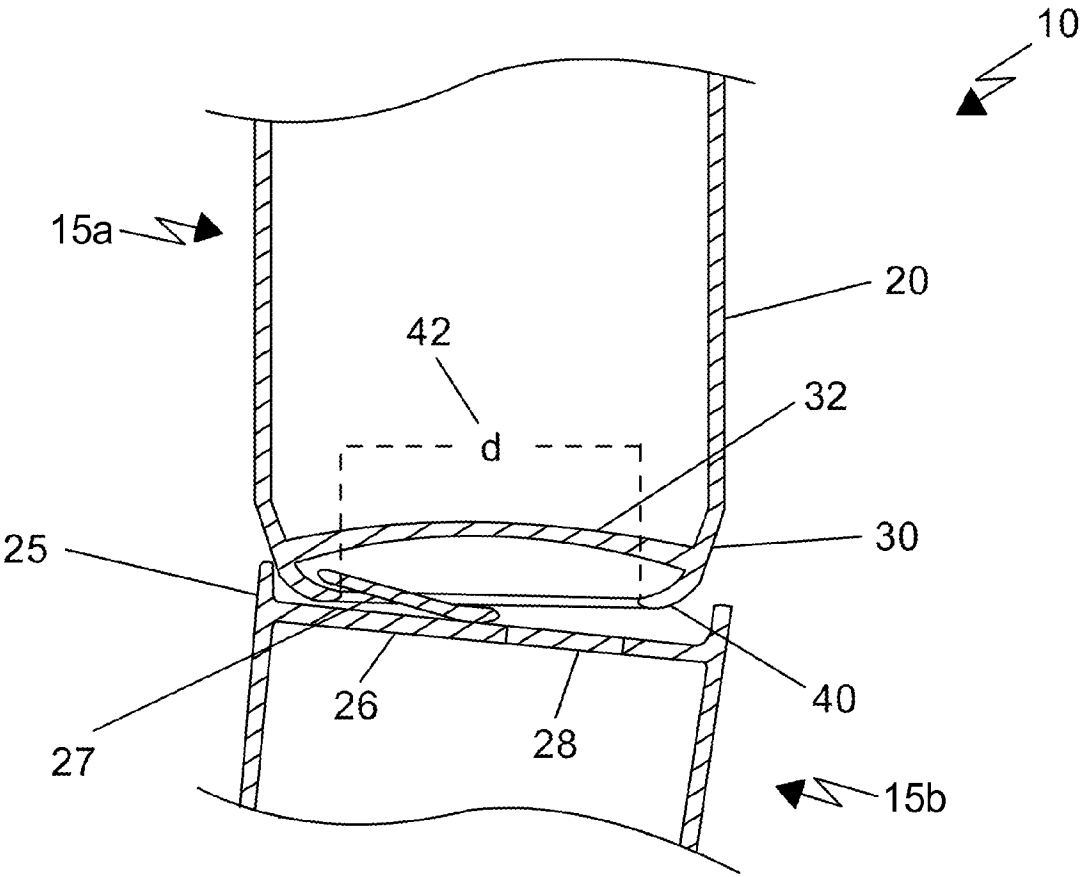

Referring now to FIG. 4, which shows a section view of the apparatus 10. The tab lifting flange 40 extends approximately one-eighth (⅛) of an inch inwardly from the perimeter edge of the bottom flange 30 to form a circular and generally flat surface forming the central bottom groove 42. In use, the tab lifting flange 40 of a superjacent can 15*a* (e.g., positioned directly above) engages the free end of the tab 27 of a subjacent can 15*b* (e.g., positioned directly below) and provides a lever to lift the tab 27 of the subjacent beverage can 15*b* upwardly when inserted beneath the tab 27 of the subjacent beverage can 15*b*. The device 10, as the superjacent (e.g., superjacently positioned) can 15*a*, is motioned in a rearwardly directed arc to pry the tab 27 of the subjacent (e.g., subjacently positioned) beverage can 15*b* upward, thus rupturing the fluid opening 28 of the subjacent beverage can 15*b*. The tab lifting flange 40 is a generally parallel surface relative to the lower surface 32 of the can 15 so as to not interfere with normal function of the bottom flange 30. The tab lifting flange 40 allows the device 10 to sit flat upon a supporting surface such as a table top or counter without interference and allows for a plurality of devices 10 to be stacked in a traditional manner.

It can be appreciated by one skilled in the art that other styles and configurations of the invention can be easily incorporated into the teachings of the present disclosure and only one particular configuration has been shown and described for purposes of clarity and disclosure and not by way of limitation of scope.

In accordance with the invention, the preferred embodiment can be utilized by the user in a simple and effortless manner with little or no training. After initial purchase or acquisition of the device 10, it is installed and utilized as indicated in FIGS. 1 through 4.

The method of utilizing the device 10 can be achieved by performing a series of steps. It can be appreciated that the steps described can be performed in alternative order and as such should not be viewed as a limiting factor. Procuring a first device 10 filled with beverage or an empty device 10. Given at least one (1) full beverage can 15 or a full second device 10. Positioning the first device 10 above a second device 10 filled with liquid or a beverage can 15 such that the bottom flange 30 of the first beverage can 15 is slightly inserted within the top flange 25 of a second device 10 or the beverage can 15. Engaging the tab lifting flange 40 of the second device 10 or the beverage can 15 beneath a free edge of the tab 27 of the second device 10 or the beverage can 15. Tilting the device 10 rearwardly to lift the tab 27 upwardly in order to puncture the fluid opening 28 of the second device 10 or the beverage can 15. Manually completing the upward deployment of the tab 27 so as to completely clear the fluid opening 28 in a normal manner. Drinking the beverage contained within of the second device 10 or the beverage can 15 in a normal manner. Utilizing the empty second device 10 to open a full third device 10 or another beverage can 15 as previously described.

Alternatively, a full device 10 can be used to open another full device 10 or full beverage can 15. This process can be repeated as necessary to open a plurality of devices 10 or beverage cans 15 by use of the device 10. Use of the device 10 reduces the risk of breaking fingernails, hurting fingers, or requiring help from others to open a beverage can 15 afforded a user of the device 10.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. A beverage can with an integral tab lifter comprising:

a beverage can body comprising a longitudinal axis, an upper end, a lower end, and a lift tab disposed on said upper end for puncturing a fluid opening in said upper end, said upper end comprises a circular perimeter edge, and said lower end comprises a circular perimeter edge; and, a continuous annular tab lifting flange curving inwardly about an entirety of said perimeter edge of said lower end and terminating at a pointed edge perpendicular to said longitudinal axis;

wherein at least a portion of said pointed edge of said tab lifting flange of said beverage can is positionable underneath a subjacent lift tab of a subjacent beverage can to apply a lifting pressure on said subjacent lift tab when pivoted for puncturing a subjacent fluid opening of said subjacent beverage can.

2. The device of claim 1, wherein said tab lifting flange extends approximately one-eighth of an inch inwardly from said perimeter edge of said bottom end.

3. A beverage can with an integral tab lifter comprising:

a can body comprising a longitudinal axis, a cylindrical sidewall, a closed upper surface, a closed lower surface, a tapered top flange extending upwardly from a perimeter of said upper surface, a tapered bottom flange extending downwardly from a perimeter of said lower surface, a fluid opening defined by a scored area disposed in said upper surface, and a lift tab pivotably attached to said upper surface adjacent to said fluid opening, wherein said lift tab comprises a lift end on one side of a pivot point and a puncturing end on an opposite side of said pivot point and directed over said scored area;

a continuous annular tab lifting flange curving inwardly from an entirety of a perimeter edge of said bottom flange and terminating at a pointed edge perpendicular to said longitudinal axis and configured to fit underneath a subjacent lift tab of a subjacent beverage can; and, a circular bottom opening defined by a said pointed edge of said tab lifting flange configured to at least partially receive said subjacent lift tab of said subjacent beverage can when at least a portion of said pointed edge of said tab lifting flange is positioned underneath said subjacent lift tab;

wherein said tab lifting flange of said beverage can captures a subjacent lift tab lift end of said subjacent lift tab of said subjacent beverage can, and wherein said beverage can pivots about a subjacent top flange of said subjacent beverage can and said tab lifting flange lifts said subjacent lift tab for puncturing a subjacent upper surface of said subjacent beverage can about a subjacent scored area of said subjacent beverage can.

4. The device of claim 3, wherein said tab lifting flange extends approximately one-eighth of an inch inwardly from said perimeter edge of said bottom flange.

5. The device of claim 4, wherein said tab lifting flange is generally parallel to said lower surface such that said can body can rest upon a flat surface.

6. The device of claim 5, wherein:

said bottom flange of said beverage can comprises a bottom diameter, said subjacent top flange of said subjacent beverage can comprises a top diameter, said bottom diameter is smaller than said top diameter, and said bottom flange of said beverage can nests inside said subjacent top flange of said subjacent beverage can.

* * * * *